US010035183B2

(12) United States Patent
Gonda et al.

(10) Patent No.: US 10,035,183 B2
(45) Date of Patent: Jul. 31, 2018

(54) METHOD FOR MANUFACTURING A CAST BAR AND TUBE MADE OF A MAGNESIUM ALLOY

(71) Applicant: GONDA METAL INDUSTRY CO., LTD., Sagamihara-shi, Kanagawa (JP)

(72) Inventors: Yoshio Gonda, Sagamihara (JP); Gentaro Gonda, Sagamihara (JP); Kazunari Yoshida, Atsugi (JP); Toshio Haga, Osaka (JP)

(73) Assignee: GONDA METAL INDUSTRY CO., LTD., Sagamihara-Shi, Kanagawa (JP)

( * ) Notice: Subject to any disclaimer, the term of this patent is extended or adjusted under 35 U.S.C. 154(b) by 0 days.

(21) Appl. No.: 15/489,205

(22) Filed: Apr. 17, 2017

(65) Prior Publication Data

US 2017/0216910 A1 Aug. 3, 2017

Related U.S. Application Data

(63) Continuation of application No. 14/373,566, filed as application No. PCT/JP2014/000137 on Jan. 15, 2014.

(30) Foreign Application Priority Data

Jan. 17, 2013 (JP) ..... 2013-006762
Mar. 21, 2013 (JP) ..... 2013-058019

(51) Int. Cl.

| | |
|---|---|
| ***B22D 18/06*** | (2006.01) |
| ***B22D 21/00*** | (2006.01) |
| ***B22D 27/04*** | (2006.01) |
| ***B22D 27/08*** | (2006.01) |
| ***B22C 9/26*** | (2006.01) |
| ***B22D 9/00*** | (2006.01) |
| ***B22D 11/00*** | (2006.01) |
| ***B22D 11/10*** | (2006.01) |
| ***B22D 11/114*** | (2006.01) |

(Continued)

(52) U.S. Cl.

CPC ..... *B22D 18/06* (2013.01); *B22C 9/26* (2013.01); *B22D 9/006* (2013.01); *B22D 11/001* (2013.01); *B22D 11/003* (2013.01); *B22D 11/006* (2013.01); *B22D 11/10* (2013.01); *B22D 11/114* (2013.01); *B22D 21/007* (2013.01); *B22D 27/04* (2013.01); *B22D 27/08* (2013.01); *C22C 21/00* (2013.01); *C22C 23/00* (2013.01)

(58) Field of Classification Search

CPC ..... B22D 9/006; B22D 18/06; B22D 21/00; B22D 21/007; B22D 27/04; B22D 27/08; B22C 9/26

USPC ..... 164/257, 258, 260, 61, 63, 71.1

See application file for complete search history.

(56) References Cited

U.S. PATENT DOCUMENTS 5,299,619 A * 4/1994 Chandley et al. ..... B22D 27/04 164/133
5,303,762 A * 4/1994 Chandley ..... B22D 18/06 164/255

* cited by examiner

*Primary Examiner* — Kevin P Kerns
(74) *Attorney, Agent, or Firm* — Manabu Kanesaka

(57) ABSTRACT

A manufacturing method for a cast bar and tube made of a magnesium alloy, includes steps of preparing a manufacturing device; depressurizing a vacuum chamber through a depressurization device; heating a vicinity of an opening of a hollow tube; inserting the opening of the hollow tube into a molten metal; switching a valve member to be open; introducing the molten metal into a cylindrical part, and filling the cylindrical part with the molten metal; cooling the (Continued)

hollow tube; and continuously vibrating the hollow tube until completing solidification of the molten metal in the cylindrical part.

5 Claims, 6 Drawing Sheets

(51) Int. Cl.
*C22C 21/00* (2006.01)
*C22C 23/00* (2006.01)

METHOD FOR MANUFACTURING A CAST BAR AND TUBE MADE OF A MAGNESIUM ALLOY

RELATED APPLICATIONS

The present application is a continuation application of U.S. patent application Ser. No. 14/373,566 filed on Jul. 21, 2014 and presently abandoned, which is a national phase entry of International Application No. PCT/JP2014/000137 filed on Jan. 15, 2014, which claims priorities from Japanese Application No. 2013-006762 filed on Jan. 17, 2013 and Japanese Application No. 2013-058019 filed on Mar. 21, 2013, the disclosures of which are incorporated herein by reference.

TECHNICAL FIELD

The present invention relates to a manufacturing method for a cast bar and tube made of a magnesium alloy.

BACKGROUND ART

For example, a magnesium alloy which is excellent in ductility to yield a large cross-sectional area and length in casting is in demand since it can be used as the material for the casting process and the plastic working in post processing. In the past, a sand casting process (for example, refer to Patent Literature 1), a lost wax process (for example, refer to Patent Literature 2) and the like are known as the manufacturing method of the magnesium alloy which is excellent in ductility to yield a large cross-sectional area and length in casting. A continuous casting method is also used as the manufacturing method of the magnesium alloy (for example, refer to Patent Literature 3).

The manufacturing method for the magnesium alloy described in the following Patent Literatures 1 to 3 make possible manufacture of the magnesium alloy which is excellent in ductility to yield a large cross-sectional area and length in casting.

CITATION LIST

Patent Literature

Patent Literature 1: JP 2-274366 A
Patent Literature 2: JP 3-57552 A
Patent Literature 3: JP 3-133543 A

SUMMARY OF INVENTION

Technical Problem

However, the manufacturing method of a cast bar by the sand casting process described in Patent Literature 1 and by the lost wax process described in Patent Literature 2 cannot yield a cast bar with good processability because the cooling rate is slow. It cannot be said that such casting processes have high productivity.

To the contrary, the continuous casting process described in Patent Literature 3 allows rapid coagulation by cooling so that the cast bar manufactured has good processability but a problem in which it is difficult to respond to the variety of cross-sectional shapes in casting. There is also a problem in which the casting speed and its productivity are low, since molten metal is gradually drawn out for yielding the cast bar while coagulating.

The present invention is a new invention which was carried out in view of the aforementioned problems, and its purpose is to provide a manufacturing device for a cast bar and tube to respond to the variety of shapes in casting in high productivity, and the metal material obtained by the device.

Solution to Problem

A manufacturing device for a cast bar and tube related to the present invention includes: a molten metal furnace for holding a dissolved cast material; a hollow tube including a penetrating part of molten metal for penetrating the molten metal, the hollow tube can be freely inserted into and withdrawn from the molten metal furnace; a depressurization device to reduce the pressure; a connection member of connecting the hollow tube to the depressurization device; and an open/close type valve member installed on the connection member, wherein the penetrating part of molten metal is depressurized by switching the valve member to the closed state to reduce the pressure in the side of the depressurization device from the valve member using the depressurization device and inserting an opening of the hollow tube into the molten metal furnace as well as by switching the valve member to the open state, thereby penetrating molten metal into the penetrating part of molten metal under reduced pressure to solidify in the penetrating part of molten metal to manufacture a long belt-like member.

The manufacturing device for a cast bar and tube related to the present invention can also be provided with cooling device for cooling the hollow tube.

The manufacturing device for a cast bar and tube related to the present invention is can also be provided with vibrating device for applying vibration to the hollow tube.

Incidentally, in the manufacturing device for a cast bar and tube related to the present invention the vibrating device can include a type of enforced vibration in which physical vibration is externally applied, a type in which vibration is applied with ultrasound waves or a type in which vibration is applied using electromagnetic induction.

The manufacturing device for a cast bar and tube related to the present invention is also provided with a heating device for heating the hollow tube, and it is preferred to insert an opening of the hollow tube into the molten metal furnace after heating the vicinity of the opening of the hollow tube with the heating device.

In the manufacturing device for a cast bar and tube related to the present invention the casting material can also be constituted with a lightweight metal of magnesium or aluminum as a main component.

In the manufacturing device for a cast bar and tube related to the present invention the hollow tube is constituted with the components divided into a suction mouth connected to the connection member, a forming part of a cast bar and tube for forming a cast bar and tube, and a supply tube part of molten metal having an immersion part of molten metal immersed in the molten metal and an exposed part which is exposed to the outside of the molten metal furnace, and the molten metal in the molten metal furnace can be introduced into the forming part of a cast bar and tube by connecting the forming part of a cast bar and tube to the exposed part of the supply tube part of molten metal as well as by connecting the suction mouth to the forming part of a cast bar and tube.

A metal material related to the present invention is also the metal material manufactured with the aforementioned manufacturing device for a cast bar and tube, wherein the internal structure is the spheroidized structure.

A metal material related to the present invention can further be the material in which cracks or seams are not formed.

Advantageous Effect of Invention

The present invention provides a manufacturing device which can manufacture a long belt-like cast bar and tube with the variety of cross-sectional shapes at low cost but in high quality as well as with high productivity.

The present invention can also prevent molten metal from oxidation and ensures safety in manufacturing operation, since molten metal is neither exposed to outside air nor cooling water.

Further, the present invention can also reduce the consumption of energy required for cooling, since the casting can be performed in the solid-phase fraction of 50% or more.

The present invention further prevents a cast bar and tube from deterioration in quality, since molten metal is never exposed to air in casting.

DESCRIPTION OF EMBODIMENTS

Hereinafter, an embodiment suitable for working of the present invention will be described using drawings.

Incidentally, the following embodiments and examples are in no way to limit the invention related to each claim and a combination of all characteristics described in the embodiments and examples is also not always essential as a means for solving the problems in the invention.

First Embodiment

Figure 1:
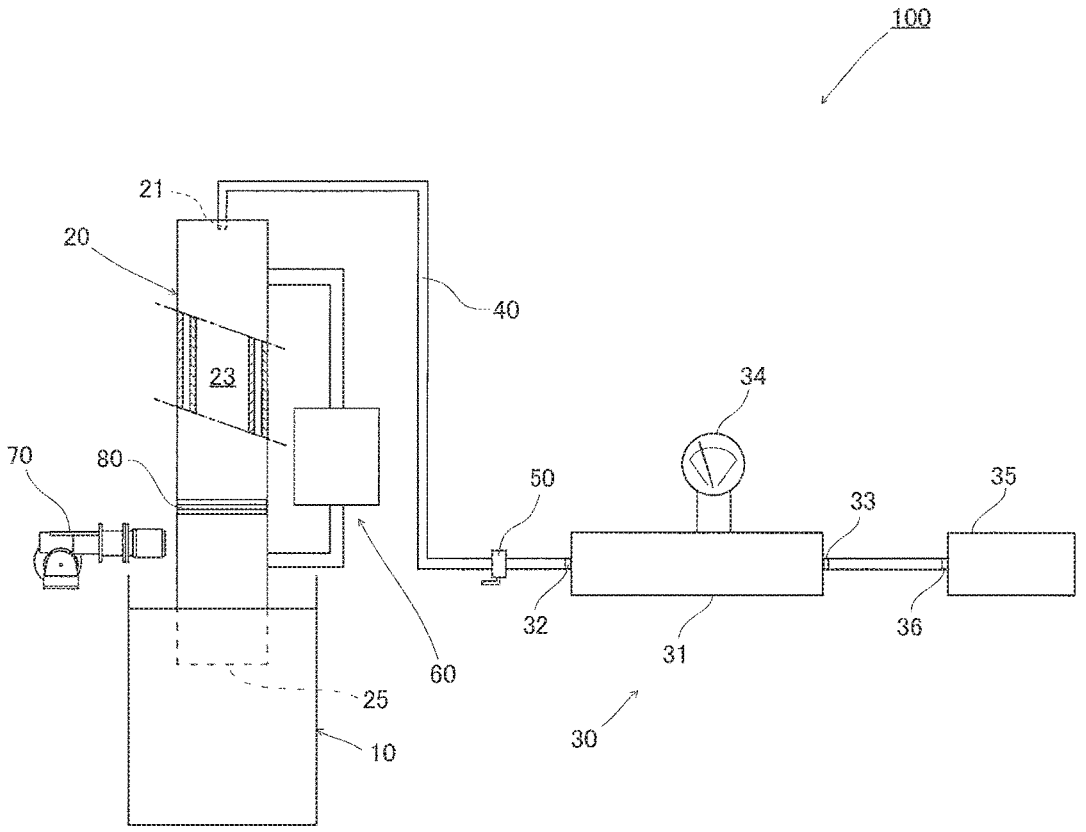
FIG. 1 is a view illustrating a constitutional example of a manufacturing device for a cast bar and tube related to a first embodiment.

FIG. 1 is a view illustrating a constitutional example of a manufacturing device for a cast bar and tube related to a first embodiment.

As illustrated in FIG. 1, a manufacturing device 100 for a cast bar and tube related to the first embodiment includes a molten metal furnace 10, a hollow tube 20, a depressurization device 30, a connection member 40, a valve member 50, a cooling device 60, a heating device 70, and a vibrating device 80.

The molten metal furnace 10 is a pot to hold the dissolved casting material as the molten metal.

A casting material is constituted with a lightweight metal material as a main component. The lightweight metal material is generally defined as the metal material with the specific gravity of 4.0 or less. That is, the lightweight metal material related to the first embodiment includes magnesium, aluminum, and the like. Incidentally, calcium, zinc, and the like may be added as an additive to the lightweight metal material related to the first embodiment. When manufacturing a magnesium alloy, a flame resistant magnesium alloy (for example, alloy in which 6% of aluminum, 1% of zinc, and 2% of calcium relative to magnesium are added) is preferably used as a casting material in order to prevent molten metal from bumping under reduced pressure. As the casting material, for example, a magnesium alloy such as "Mg+0.5% Ca", "Mg+1% Zn+0.5% Ca", "Mg+8% Zn+1% Ca", "Mg+10% Zn+1% Ca", and the like can also be used.

The hollow tube 20 is configured to be freely inserted into or withdrawn from the molten metal furnace 10 and serves as a "mold". The hollow tube 20 also includes a suction mouth 21 connected to the connection member 40, a penetrating part 23 of molten metal formed in a hollow shape, and the opening 25 which is inserted into the molten metal. While an opening 25 in the present example has one opening formed at the lower end of the hollow tube 20, a plurality of the opening may be formed and the opening may be formed at the location other than the lower end.

Figure 2:
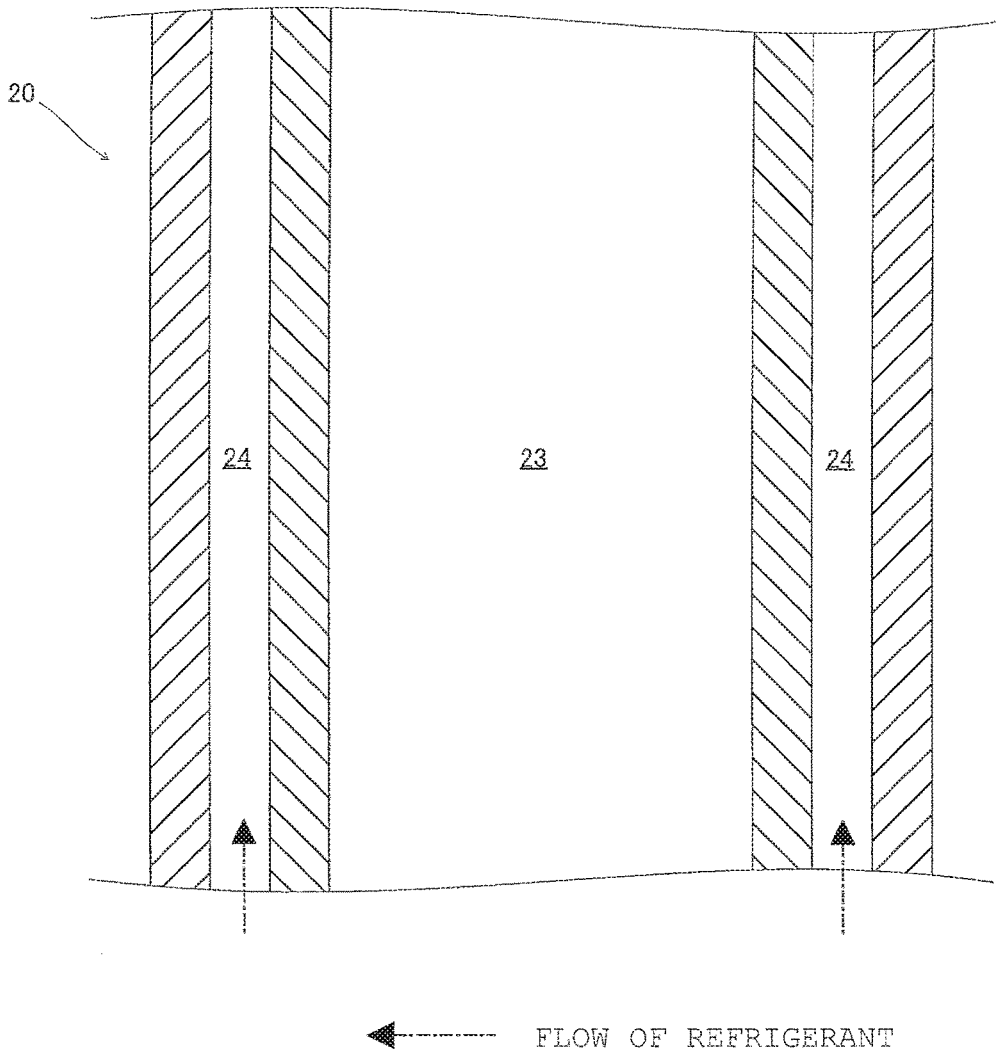
FIG. 2 is a sectional view illustrating the cross-section of a hollow tube related to the first embodiment when cut in the longitudinal direction.

FIG. 2 is a sectional view illustrating the cross-section of a hollow tube when cut in the longitudinal direction. As illustrated in FIG. 2, the hollow tube 20 has the double tube structure of which a layer of the cooling layer 24 is further formed outside the penetrating part 23 of molten metal. The cooling layer 24 serves as the route for a refrigerant such as cooling water and the like discharged from the cooling device 60 described below. Incidentally, the cooling layer 24 may be spirally formed along the circumferential surface of the hollow tube 20, and furthermore it may be formed with varying the pack density of the spiral tube depending on the height of the hollow tube 20.

The hollow tube 20 is a pipe member formed in a long belt-like cylindrical shape, and as its raw material, for example, an iron type material and the like are used. Thickness formed by the difference between the outside diameter and the inside diameter (hereinafter, refer to as thickness) is also appropriately selected depending on a casting material and a manufacturing purpose. That is, since the hollow tube 20 is neither expensive nor difficult to change as a mold, it can be selected among hollow tubes with the wide variety of thickness for manufacturing a cast bar and tube. Since the cooling rate of molten metal is varied with variation of the thickness of the hollow tube 20, the quality of the cast bar and tube manufactured is varied. That is, a cast bar and tube with the variety of properties can be manufactured depending on a casting material and the manufacturing purpose.

The suction mouth 21 is formed at an end of the hollow tube 20 in the longitudinal direction and configured such that it can be connected to the connection member 40. And a gas is sucked from the suction mouth 21 into the penetrating part 23 of molten metal by utilizing a negative pressure generated by a vacuum pump 35, thereby enabling to create a negative pressure in the penetrating part 23 of molten metal.

The penetrating part 23 of molten metal is the part into which molten metal is penetrated to solidify forming a cast bar and tube.

The opening 25 is located at an end of the hollow tube 20 in the longitudinal direction and formed at the location opposite to the location at which the suction mouth 21 is formed. The opening 25 is inserted into molten metal in the molten metal furnace 10 and serves as the penetrating mouth for penetrating the molten metal into the penetrating part 23 of molten metal.

The opening 25 may be configured such that a protrusion (not illustrated) is provided in order to prevent the molten metal from penetrating into the center of the hollow tube 20. Such configuration allows for solidifying the molten metal in the state in which the core portion is hollowed, thereby enabling to manufacture a tubular cast product. Configuration in which gas is introduced into the center of the opening 25 may be used for obtaining similar effects.

The depressurization device 30 is a group of devices for reducing the pressure in the penetrating part 23 of molten metal, and configured such that it includes a vacuum chamber 31 and a vacuum pump 35. The depressurization device 30 is configured to allow adjustment of pressure depending on various conditions such as a casting material, the manufacturing purpose, the inside diameter of the hollow tube 20, and the like.

The vacuum chamber 31 is provided with a suction part 32 and a deaeration port 33 and is the vessel for keeping stable a negative pressure in the confined space. The vacuum chamber 31 is also provided with a pressure gauge 34.

The suction part 32 is connected to the suction mouth 21 through the connection member 40 in order to communicate with the penetrating part 23 of molten metal the suction force based on the state of a negative pressure generated by the vacuum pump 35.

The deaeration port 33 is connected to an intake vent 36 of the vacuum pump 35 in order to generate the state of negative pressure.

The pressure gauge 34 can measure the pressure inside the vacuum chamber 31 in which the pressure is varied by operation of the vacuum pump 35.

The vacuum pump 35 is provided with an intake vent 36, a pump (not illustrated), and the like, and suctions a gas inside the vacuum chamber 31 from the intake vent 36 by the sucking action of the pump. Incidentally, the vacuum pump 35 is provided with an exhaust port when exhaustion is structurally required, while not particularly illustrated in the present example.

The connection member 40 connects the suction mouth 21 of the hollow tube 20 to the suction part 32 of the vacuum chamber 31 and is configured such that an exchange flow of air between the suction mouth 21 and the suction part 32 can occur.

The connection member 40 used is very flexible and formed in a hollow shape, and has the properties in which failure such as breakage and the like does not occur even when the inside of the hollow tube is under negative pressure. Therefore, for example, a tube made from silicone is used as the connection member 40.

The valve member 50 is installed on the connection member 40 and configured as an open/close type valve. Switching the valve member 50 to the open state generates the state in which an exchange flow of a gas in the penetrating part 23 of molten metal with a gas in the vacuum chamber 31 can occur. On one hand, switching the valve member 50 to the closed state generates the state in which an exchange flow of a gas in the penetrating part 23 of molten metal with a gas in the vacuum chamber 31 does not occur. That is, when the valve member 50 is switched to the closed state, an exchange flow of a gas can occur only between the valve member 50 and the vacuum chamber 31.

The cooling device 60 is configured to cool the hollow tube 20 from its outside. Specifically, the cooling device 60 injects cooling water from the lower part of the hollow tube 20 into the cooling layer 24 of the hollow tube 20 with the double tube structure. The cooling water injected flows to the upper part of the hollow tube 20. The cooling water flown to the upper part of the hollow tube 20 is cooled to reinject from the lower part of the hollow tube 20. Such configuration can maximize the cooling effects at the location (that is, the lower side of the cooling device 60) in the vicinity of the molten metal furnace 10 at which the temperature is higher in the hollow tube 20, thereby enabling to uniformly cool the entire length of the hollow tube 20. That is, since temperature fluctuation depending on the height of molten metal penetrated can be corrected, a cast bar and tube manufactured can be uniform in quality. Controlling the cooling effects by the cooling device 60 depending on the inside diameter of the hollow tube 20 can also adjust various properties (for example, flow stress, cutting force, and the like) of a cast bar and tube solidified.

The cooling device 60 is further configured such that the injection rate and the water temperature of cooling water injected are freely adjusted. Such configuration can generate different cooling states so that not only the hollow tube 20 can be uniformly cooled across the full length but also the cast bar and tube can be intentionally prepared such that its cross-section has a rapid cooled and solidified portion and a slowly cooled and solidified portion.

The cooling device 60 is configured to inject cooling water into the cooling layer 24, but may be configured such that the hollow tube 20 is directly wound with the cooling tube (not illustrated) without using the cooling water and cooling water is injected into the cooling tube. Further, the cooling device 60 of the present example uses cooling water as a refrigerant, but it may be configured to use a gas as a refrigerant. Specifically, it may be configured to circulate a noble gas such as argon and the like from the lower part of the cooling device. Further, the cooling device 60 may also be configured to have a fin directly attached to the hollow tube. Increase of the surface area by addition of the fin results in the higher cooling effects.

The heating device 70 is configured such that the vicinity of the opening 25 is heated when the opening 25 of the hollow tube 20 is inserted into molten metal. As the heating device 70, for example, a burner is used. Such configuration can prevent breakage of the hollow tube caused by the large temperature difference when inserted and plugging of the hollow tube caused by rapid solidification. Therefore, failure in manufacture of a cast bar and tube can be reduced.

The vibrating device 80 is directly installed on the hollow tube 20 and configured such that vibration is applied across the entire hollow tube 20 to penetrate molten metal into the penetrating part 23 of molten metal until completing solidification. Incidentally, the vibrating device 80 may be configured, for example, to apply vibration with ultrasound waves.

Thereinbefore, a constitutional example of the manufacturing device 100 for a cast bar and tube related to the first embodiment is described.

An operation example of the manufacturing device 100 for a cast bar and tube related to the first embodiment will be next described. Description herein starts with the state in which the valve member 50 is open and the depressurization device 30 is not operated.

Firstly the valve member 50 is switched to the closed state. Switching the valve member 50 to the closed state generates the state in which an exchange flow of air between the penetrating part 23 of molten metal and the vacuum chamber 31 cannot occur. Therefore, the space between the valve member 50 and the vacuum chamber 31 generates the confined state.

After the valve member 50 is switched to the closed state, the vacuum pump 35 is operated. Operation of the vacuum pump 35 reduces the pressure of the confined space between the valve member 50 and the vacuum chamber 31.

When the vacuum pump 35 is operated to generate a given pressure in a confined space indicated by the pressure gauge 34, operation of the vacuum pump 35 is stopped. A given pressure hereat can be appropriately varied depending on the outside diameter, the thickness, and the length of the hollow tube 20. Incidentally, when a short cast bar and tube is desired to manufacture, it can be manufactured, for example, even when the pressure is close to atmospheric pressure (in a range of 0.8 atm), since the length of a cast bar and tube manufactured is determined by pressure. On one hand, when a long cast bar and tube is desired to manufacture, a desired cast bar and tube can be manufactured, for example, by reducing the pressure to a high vacuum level.

When operation of the vacuum pump 35 is stopped, heating of the vicinity of the opening 25 in the hollow tube 20 with the heating device 70 is subsequently initiated.

When the vicinity of the opening 25 is heated for a given time, the opening 25 is inserted into molten metal. A span of the hollow tube 20 in which the side of the opening 25 is immersed in the molten metal is preferably equal to the portion of the hollow tube 20 heated by the heating device 70.

After the opening 25 is inserted into the molten metal, the valve member 50 is switched from the closed state to the open state.

When the valve member 50 is switched to the open state, a gas in the penetrating part 23 of molten metal in the hollow tube 20 is sucked into the suction mouth 21 by the pressure difference between the penetrating part 23 of molten metal in the hollow tube 20 and the vacuum chamber 31 bounded by the valve member 50. Molten metal is penetrated at once from the opening 25 into the penetrating part 23 of molten metal as a gas in the penetrating part 23 of molten metal in the hollow tube 20 is sucked into the suction mouth 21. Such configuration in which pressure difference is utilized for suction can solidify the molten metal under reduced pressure in a manufacturing step of a cast bar and tube so that quality of the cast bar and tube manufactured can be improved. Further, since casting can be performed at the temperature to yield the solid phase fraction of 50% or more in a cast bar and tube, energy consumption for cooling can be reduced. Further, solidifying molten metal under reduced pressure leads to improve the internal structure of a metal material casted.

As molten metal starts to penetrate into the penetrating part 23 of molten metal, the cooling device 60 discharges cooling water into the cooling layer 24 of the hollow tube 20. Discharging cooling water into the hollow tube 20 allows for achieving a desired cooling rate in response to the height of the hollow tube 20. That is, since temperature fluctuation depending on the height of the molten metal penetrated can be corrected, quality of a cast bar and tube manufactured can be consistently uniform.

Operation of the vibrating device 80 further applies vibration to the hollow tube 20. Since application of vibration to the hollow tube 20 stirs molten metal, the molten metal in the penetrating part 23 of molten metal can be solidified in a state in which the casting material is uniformly mixed. Incidentally, operation of the vibrating device 80 may be stopped before complete solidification of the molten metal in the penetrating part 23 of molten metal, but it is preferred to continuously vibrate the vibrating device 80 until complete solidification of the molten metal in the penetrating part 23 of molten metal. Continuous vibration of the molten metal until solidified in the penetrating part 23 of molten metal can improve wettability of the interface with the material penetrated into the penetrating part 23 of molten metal, thereby resulting in better release of a cast bar and tube from a mold.

The molten metal penetrated into the penetrating part 23 of molten metal is thereafter solidified by decreasing the temperature. Therefore, the hollow tube 20 is filled with the molten metal at given height and no molten metal is penetrated above its height any Hereat, suction of the molten metal is preferably continued until coagulation of the molten metal. Continuing suction of the molten metal until its coagulation results in sucking air into the molten metal when coagulated, thereby generating the degassing effects. Therefore, in a coagulated material formation of internal defects such as blow hole and the like can be prevented to yield a cast bar and tube with better quality.

Incidentally, as described above, the length of a cast bar and tube manufactured is determined by the magnitude of reduced pressure. Therefore, molten metal can be sucked up to the length of a cast bar and tube manufactured which is determined based on the specific gravity of a metal material. This indicates that when a cast bar and tube shorter in length than one determined based on the specific gravity of a metal material is desired to manufacture, providing a means for cutting off the supply of the molten metal to the hollow tube 20 allows for manufacturing a metal material with a desired length. However, even in this case suction of the molten metal is preferably continued until its coagulation, and continuation of sucking the molten metal can effectively prevent formation of internal defects.

The hollow tube 20 is withdrawn from molten metal in response to stop the suction of the molten metal. And the inside of the molten metal penetrated is completely solidified with temperature decrease. A cast bar and tube is manufactured in this way. Incidentally, a cast bar and tube solidified in the penetrating part 23 of molten metal slightly shrinks as compared to the inside diameter of the penetrating part 23 of molten metal along with a progress of solidification thereafter by cooling so that the cast bar and tube manufactured can be readily released from the hollow tube 20 without any problem.

As thereinbefore, configuration in the first embodiment is adopted such that it has the molten metal furnace 10 for holding a dissolved casting material and the penetrating part 23 of molten metal for penetrating the molten metal, and is provided with the hollow tube 20 which can be freely inserted into and withdrawn from the molten metal furnace 10, the depressurization device 30 for reducing the pressure, the connection member 40 for connecting the hollow tube 20 to the depressurization device 30, and the open/close type valve member 50 installed on the connection member 40, and the penetrating part 23 of molten metal is depressurized by switching the valve member 50 to the closed state to reduce the pressure in the side of the depressurization device 30 from the valve member 50 using the depressurization device 30 and inserting the opening 25 of the hollow tube 20 into the molten metal furnace 10 as well as by switching the valve member 50 to the open state, thereby penetrating the molten metal into the penetrating part 23 of molten metal under reduced pressure to solidify in the penetrating part 23 of molten metal for manufacturing a long belt-like member. Therefore, a cast bar and tube can be manufactured easily in a short time and at low cost.

Particularly the first embodiment has the configuration in which molten metal is penetrated into the tube to solidify in it so that a cast bar and tube can be manufactured without exposing the molten metal to outside air. Therefore, molten metal can be prevented from oxidation and safety in manufacturing of a cast bar and tube can be ensured.

In the first embodiment a cast bar and tube is further manufactured by sucking molten metal at once using the pressure difference so that even when a material with the solid phase fraction of 50% or more is used, a cast bar and tube can be manufactured in high quality as well as in a short time. Therefore, a manufacturing device for a cast bar and tube which can be produced in high productivity but at low cost can be provided.

In the first embodiment the penetrating part 23 of molten metal is further integrated in a form of an approximately cylindrical space and is configured such that molten metal is penetrated into the space to coagulate. Therefore, cracks and seams ("cracks and seams" herein are mold marks inevitably formed on the surface of a metal material manufactured in a conventional direct chill casting (DC casting)) formed on the surface of a metal material in the conventional continuous and intermittent casting method such as DC casting are not formed in a metal material casted by the way used in the first embodiment. That is, since a metal material in which a bumpy surface is not formed on the outer circumferential surface along approximately entire length can be manufactured, a cast bar and tube can be not only easily released from a mold but also manufactured in a clean and smooth contour without special processing. Therefore, the production efficiency of a cast bar and tube is exponentially improved.

Further, since a bar and tube with the solid-phase fraction of 50% or more can be casted, the first embodiment has an advantage of reducing the energy required for cooling.

Thereinbefore, the manufacturing device 100 for a cast bar and tube related to the first embodiment is described. An example of the embodiment in which a manufacturing device for a cast bar and tube related to the present invention can be formed in other type will be described using FIG. 3. Incidentally, the same reference signs are used in the same or similar configuration to the manufacturing device 100 for a cast bar and tube related to the first embodiment described above, and its description is omitted in some case.

Second Embodiment

Figure 3:
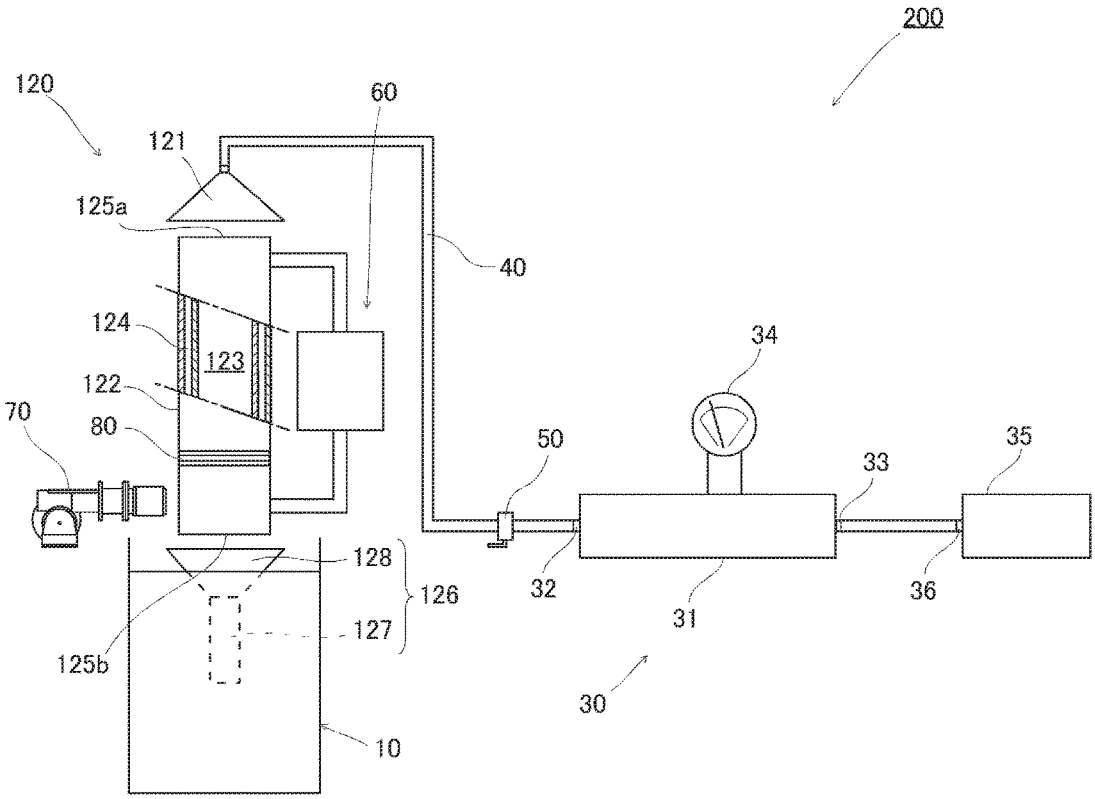
FIG. 3 is a view illustrating a constitutional example of a manufacturing device for a cast bar and tube related to a second embodiment.

FIG. 3 is a view illustrating a constitutional example of a manufacturing device 200 for a cast bar and tube related to a second embodiment. As illustrated in FIG. 3, a hollow tube 120 is constituted with the components divided into a suction mouth 121, a forming part 122 of a cast bar and tube, and a supply tube part 126 of molten metal.

The suction mouth 121 is an umbrella-shaped member for connecting the connection member 40 to the forming part 122 of a cast bar and tube. The suction mouth 121 is configured to run up and down and to connect to the forming part 122 of a cast bar and tube when descended. Incidentally, its connection to the forming part 122 of a cast bar and tube occurs mainly at the timing when the molten metal is penetrated into the penetrating part 123 of molten metal in the forming part 122 of a cast bar and tube.

The forming part 122 of a cast bar and tube includes the penetrating part 123 of molten metal formed in a hollow shape and is configured to form a double tube in which a layer of the cooling layer 124 is further formed outside the penetrating part 123 of molten metal. And the forming part 122 of a cast bar and tube has the opening (125*a* and 125*b*) at both ends, which is different from the first embodiment. In the opening (125*a* and 125*b*) at both ends, the opening at one end is connected to the suction mouth 121 and the opening at other end is connected to an exposed part 128 of the supply tube part 126 of molten metal.

The supply tube part 126 of molten metal includes an immersion part 127 and the exposed part 128, and is configured such that the immersion part 127 is immersed up to the middle layer of molten metal. Such configuration allows for penetrating the molten metal into the penetrating part 123 of molten metal from the location at which the molten metal is mixed well.

The immersion part 127 is installed such that it is immersed in part or in whole in molten metal, and is configured in a tubular shape. And the immersion part 127 is configured to connect its upper end to the exposed part 128.

The exposed part 128 is installed such that it is exposed outside in part or in whole from the molten metal furnace 10, and configured in a form of an inverted umbrella shape. And the exposed part 128 is configured to connect its lower end to the immersion part 127.

An operation example of the manufacturing device 200 for a cast bar and tube related to the second embodiment will be next described. Description herein starts with the state in which depressurization process between the valve member 50 and the vacuum chamber 31 is completed.

Firstly the suction mouth 121 is connected to the opening 125*a* (or 125*b*) at the upper end of the forming part 122 of a cast bar and tube such that it covers the opening. The suction mouth 121 is hereat tightly connected to the forming part 122 of a cast bar and tube with no air leak around connection.

After the suction mouth 121 is connected to the opening 125*a*, the forming part 122 of a cast bar and tube is further descended to connect the opening 125*b* (or 125*a*) to the exposed part 128.

The valve member 50 is switched to the open state after integrally connecting the suction mouth 121 to the hollow part of the forming part 122 of a cast bar and tube and the hollow part of the forming part 122 of a cast bar and tube to the supply tube part 126 of molten metal, respectively.

Molten metal is penetrated at once into the penetrating part 123 of molten metal in response to switch the valve member 50 to the open state.

Molten metal is thereafter solidified in response to temperature decrease, the hollow tube 120 is disconnected to withdraw the forming part 122 of a cast bar and tube after waiting solidification of the molten metal penetrated into the penetrating part 123 of molten metal, and the solidified object is pulled out to complete the formation of the cast bar and tube.

As thereinbefore, in the manufacturing device 200 for a cast bar and tube related to the second embodiment the hollow tube 120 is constituted with the components divided into the suction mouth 121 connected to the connection member 40, the forming part 122 of a cast bar and tube for forming a cast bar and tube, and the supply tube part 126 of molten metal having the immersion part 127 immersed in molten metal and the exposed part 128 which is exposed outside the molten metal furnace 10, and configured such that the molten metal in the molten metal furnace 10 is penetrated into the forming part 122 of a cast bar and tube by connecting the forming part 122 of a cast bar and tube to the exposed part 128 of the supply tube part 126 of molten metal as well as by connecting the suction mouth 121 to the forming part 122 of a cast bar and tube. Therefore, since the forming part 122 of a cast bar and tube is not directly contacted to molten metal, temperature difference between the high temperature portion and the low temperature portion can be controlled when cooling the molten metal sucked in to solidify. Therefore, a cast bar and tube with uniform quality can be manufactured. Since the forming part 122 of a cast bar and tube can be prevented from deterioration as compared to the one in the first embodiment, the impact of manufacturing cost reduction and the service life extension of the device can be achieved.

EXAMPLES

Figure 4:
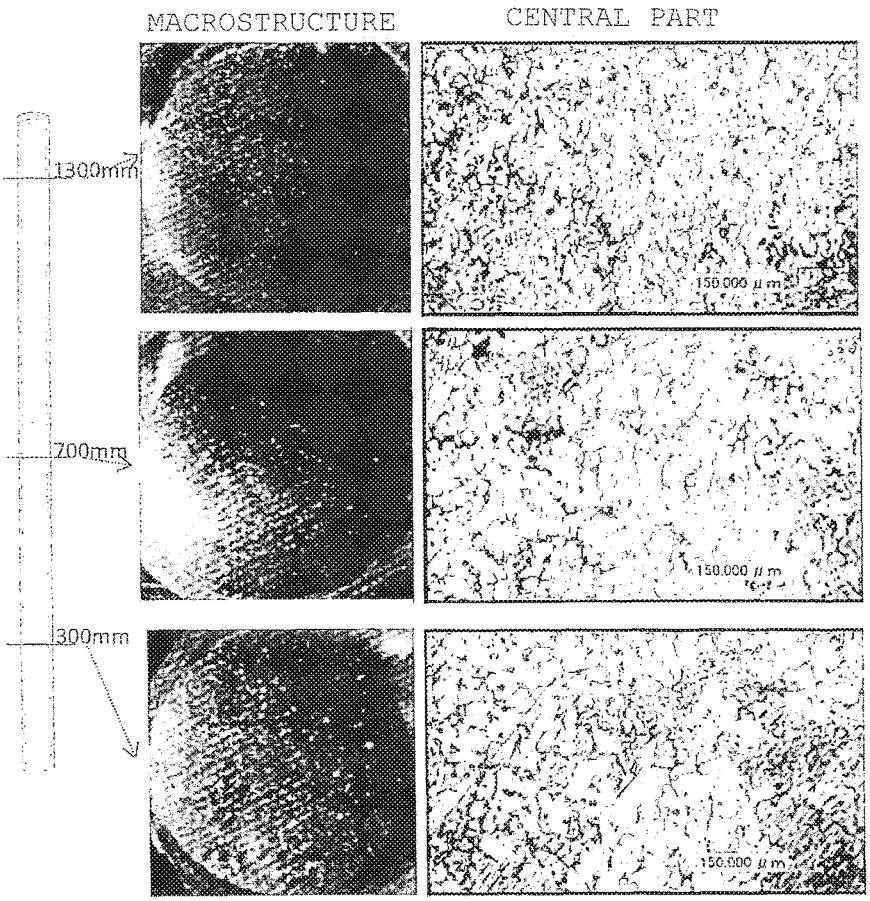
FIG. 4 is a photograph illustrating the structure of a cast bar manufactured.
Figure 5A:
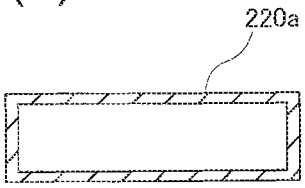
FIGS. 5(*a*) to 5(*d*) are views illustrating modified examples of a hollow tube related to the first and second embodiments.
Figure 5B:
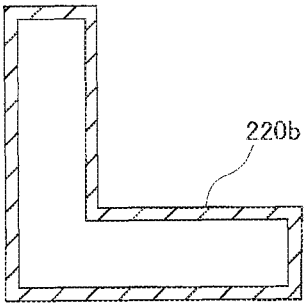
Figure 5C:
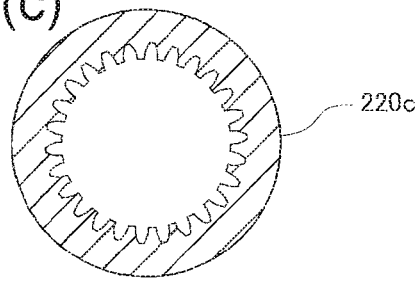
Figure 5D:
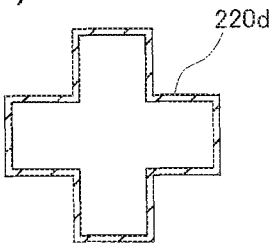

The present inventors observed the metal structure of a cast bar obtained in order to confirm the quality of a cast bar manufactured with the aforementioned device. FIG. 4 is a photograph illustrating the structure of a cast bar manufactured. As illustrated in FIG. 4, it can be found that the macrostructure and the structure of a central part of the cast bar obtained are well-developed in every location at the lower end, the middle part, and the upper end. Particularly the internal structure (structure at a central part) is not formed in the columnar crystal structure, but in the spheroidized structure. Therefore, it can be found that the cast bar manufactured is good in procesability and in resistance to deformation in processing.

The present inventors next performed an upset process using a plurality of samples with the height of 20 mm for all samples and the diameter of 21 mm, 27 mm, and 35.4 mm, respectively, in order to study the processability of the cast bar manufactured by the method of the present invention. And the present inventors compare the height of the sample before upset process to its height after upset process to evaluate the "deformation ability". Incidentally, the "deformation ability" evaluated herein is the value given by "(height before upset process−height after upset process)/(height before upset process)×100" (%), and the value closer to 100% indicates the better processability. Hereinafter, the results are shown in Table 1.

TABLE 1

| No. | Original diameter $d_0$(mm) | Original height $L_0$(mm) | Diameter after upset process d(mm) | Height after upset process L(mm) | Deformation ability $(L_0 - L)/L_0$ (%) |
|---|---|---|---|---|---|
| 1 | 27 | 20 | 50 | 6 | 70 |
| 2 | 27 | 20 | 52 | 5.2 | 74 |
| 3 | 27 | 20 | 56.5 | 4.7 | 77 |
| 4 | 35.4 | 20 | 70 | 5 | 75 |
| 5 | 35.4 | 20 | 70.5 | 5 | 75 |
| 6 | 35.4 | 20 | 78 | 4.2 | 79 |
| 7 | 21 | 20 | 50 | 3.7 | 82 |
| 8 | 21 | 20 | 44 | 4.6 | 77 |
| 9 | 21 | 20 | 43.5 | 4.6 | 77 |

As indicated in Table 1, the deformation ability in all samples is 70% or more, the magnitude being high. That is, it is found that a cast bar manufactured with the manufacturing device 100 (200) for a cast bar and tube related to the first and second embodiments is good in processability.

As indicated in aforementioned data, use of the manufacturing device 100 (200) for a cast bar and tube related to the aforementioned embodiments can manufacture a cast bar and tube with good processability.

Hereinbefore, a suitable embodiment of the present invention is described, but the technical scope of the present invention is not limited to the scope described in each of the aforementioned embodiments. It is possible to add various modification or improvement in each of the aforementioned embodiments.

For example, while the hollow tube 20 (120) related to the aforementioned embodiments is a pipe member formed in a cylindrical shape, the shape of the hollow tube related to the present invention is not limited to a cylindrical shape. FIGS. 5(*a*) to 5(*d*) are herein views illustrating modified examples of the hollow tube 20 (120) related to the two aforementioned embodiments, and particularly a view illustrating a cross-section of the hollow tube when cut in the direction orthogonal to the longitudinal direction. As illustrated in FIGS. 5(*a*) to 5(*d*), the cross-sectional shape of the hollow tube used in the manufacturing device for a cast bar and tube may be configured to be a hollow tube 220*a* in the rectangular shape, a hollow tube 220*b* in the letter L-shape, a hollow tube 220*c* in the gear-like shape, and a hollow tube 220*d* in the cruciform shape when cut in the direction orthogonal to the longitudinal direction. Since such configuration allows manufacture of a cast bar and tube depending on the cross-sectional shape, a cast bar and tube with the variety of shapes can be easily manufactured. Incidentally, a cast product manufactured using the hollow tube related to the present invention can form not only the solid bar exemplified in the aforementioned embodiments but also yield the hollow bar inside which there is an open space. In such a case, a hollow tube in which the shape of an open space corresponds to a cast product (for example, a shape of a hollow bar) desired can be adopted as the shape of the hollow tube related to the present invention.

The hollow tube 20 (120) related to the two aforementioned embodiments may also be configured such that a plurality of members is assembled for forming the penetrating part 23 (123) of molten metal. That is, one hollow tube 20 (120) may be formed by combining the two halved members. Furthermore, one hollow tube may be formed by continuously connecting a plurality of hollow members in the bamboo-like structure.

Figure 6:
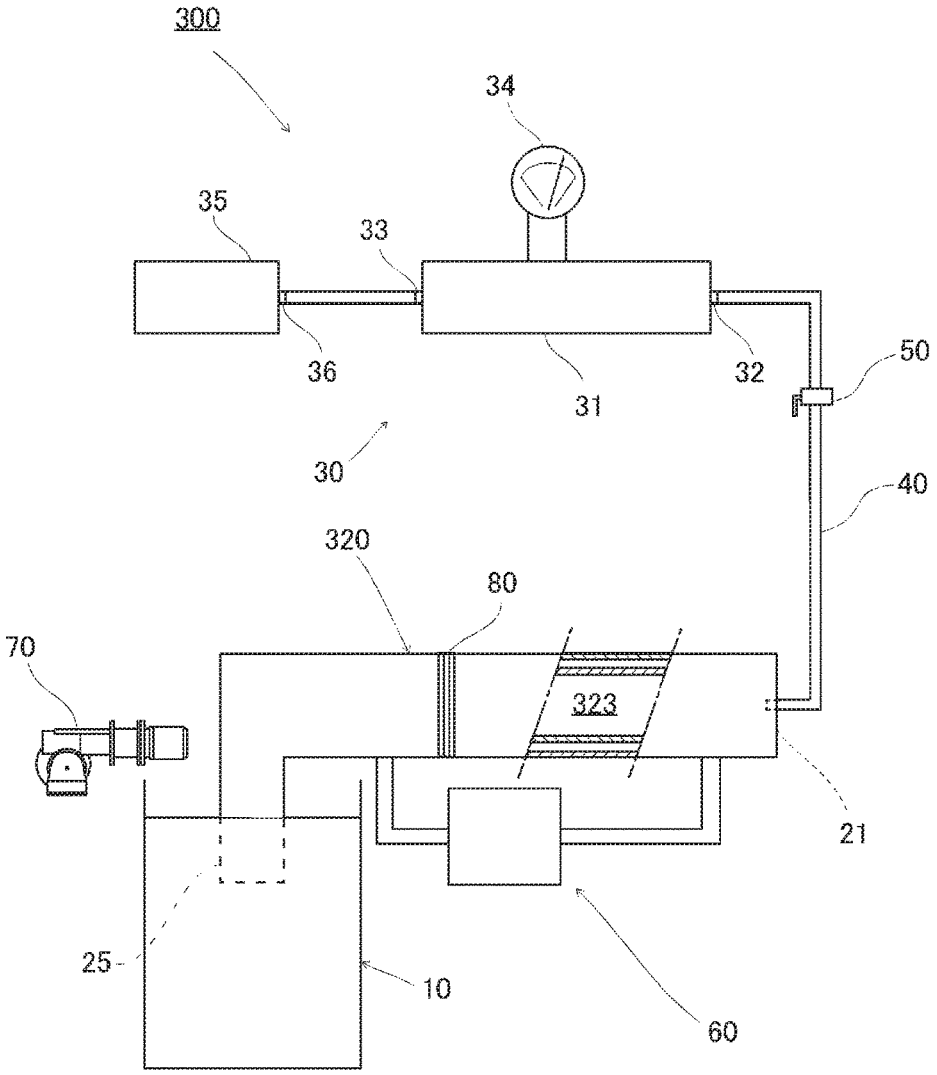
FIG. 6 is a view illustrating a modified example of the manufacturing device for a cast bar and tube related to the first and second embodiments.

The two aforementioned embodiments also use the configuration in which molten metal is penetrated into the penetrating part 23 (123) of molten metal while keeping the hollow tube 20 (120) vertical in order to make easier controlling the process up to solidification, but the scope of the present invention is not limited to such configuration. FIG. 6 is a view illustrating a modified example of the manufacturing device 100 (200) for a cast bar and tube related to the two aforementioned embodiments, and it is a manufacturing device 300 for a cast bar and tube in which molten metal is penetrated into a penetrating part 323 of molten metal while keeping the hollow tube 320 horizontal. As illustrated in FIG. 6, since the hollow tube 320 is installed to be extended in the horizontal direction, the molten metal can be sucked in without the effects of gravitation. Therefore, a longer cast bar and tube can be manufactured as compared to the case in which molten metal is pulled up vertically. Further, the configuration of pulling down the molten metal in the vertical direction or in the oblique direction can be adopted. Incidentally, the same or similar configuration to the manufacturing device 100 for a cast bar and tube related to the first aforementioned embodiment herein uses the same reference signs and its description is omitted.

The two aforementioned embodiments are also described by exemplifying the forced vibration type vibrating device 80 in which physical vibration is externally applied to the hollow tube 20 (120), but any type of forced vibration can be adopted for the vibrating device related to the present invention. That is, as aforementioned, an ultrasonic vibrating device in which vibration is applied with ultrasound waves can be used, and for example, a vibrating device using electromagnetic induction may be used.

In the vibrating device using electromagnetic induction, for example, a solenoid coil is installed on the hollow tube 20 (120) for generating the alternating magnetic field under which molten metal is raised into the hollow tube 20 (120). And the force of electromagnetic induction generated is applied to the molten metal enabling to make homogeneous the structure of a cast bar and tube and to reduce its internal defects. Incidentally, in the vibrating device using electromagnetic induction significant effects can be expressed particularly when the nonaxisymmetric shaped hollow tube is used. For example, in the case of the rectangular shaped hollow tube 220*a* use of a vibrating device based on electromagnetic induction can apply a force more suitably to the inside of molten metal as compared to the vibrating device 80 related to the aforementioned embodiment in which physical vibration is externally applied. Specifically, application of alternating magnetic field or direct current electric field in the thickness direction of plate makes possible generating the well-balancedly force directed to the center of plate. And eventually, according to the present invention a cast bar and tube uniform in quality of its inside such as internal structure can be manufactured in any shape of a hollow tube.

Incidentally, as a source for generating electromagnetic induction a direct current electric field can be used in addition to the aforementioned source. That is, a vibrating device based on any principle can be used in the present invention.

Further, in the two aforementioned embodiments, the manufacturing device is also configured to apply vibration only to the hollow tube 20 (120), but it may be configured to apply vibration to the inside of the molten metal furnace 10. Such configuration allows for penetrating molten metal without unevenness into the penetrating part 23 (123) of molten metal.

Further, in the two aforementioned embodiments the hollow tube 20 (120) may be configured to make the thickness of its upper end different from that of the lower end. Such configuration allows for correcting the difference of the cooling force caused by the temperature difference in the tube in the penetrating part 23 (123) of molten metal, thereby makings uniform the quality of a cast bar and tube manufactured.

A filter may also be attached to the opening 25 (125*a* and 125*b*). The filter of which a network of pores are formed on a circular plate with the shape matching to the shape of the opening 25 (125*a* and 125*b*) can be used. Such configuration can decrease the penetration rate of molten metal, thereby enabling to vary the cooling rate to gradually cast a bar as a whole, particularly in manufacturing of a cast bar with a large cross-sectional area so that a cast bar uniform in the internal structure can be manufactured.

It may be configured such that a plurality of the hollow tubes 20 (120) are combined and simultaneously immersed in molten metal in the molten metal furnace. Such configuration allows for simultaneously casting a plurality of cast bars and tubes to further increase the productivity.

Application of a mold release agent to the surface of the inner wall of the hollow tube 20 (120) also allows smooth release of a coagulated cast bar and tube bounded with the surface of its inner wall. The present invention is not intended to exclude use of such a mold release agent.

The condition such as the length in the longitudinal direction of the hollow tube 20 (120) related to the aforementioned embodiments and its wall thickness in the circumferential direction may be determined with appropriate adjustment depending on the diameter, the wall thickness, and the like of a cast bar and tube to be obtained and its internal structure to be obtained. That is, specific condition for manufacturing a cast product can be appropriately selected and modified within the scope not departing from the scope of claims representing the present invention.

It is obvious from the scope of claims described that the embodiment to which such modification or improvement is added is included in the technical scope of the present invention.

REFERENCE SIGNS LIST

100, 200, and 300 Manufacturing device for a cast bar and tube
10 Molten metal furnace
20, 120, 220*a*, 220*b*, 220*c*, 220*d*, and 320 Hollow tube
21 and 121 Suction mouth
122 Forming part of a cast bar and tube
23, 123, and 323 Penetrating part of molten metal
24 and 124 Cooling layer
25, 125*a*, and 125*b* Opening
126 Supply tube part of molten metal
127 Immersion part in molten metal
128 Exposed part
30 Depressurization device
31 Vacuum chamber
32 Suction part
33 Deaeration port
34 Pressure gauge
35 Vacuum pump
36 Intake vent
40 Connection member
50 Valve member
60 Cooling device
70 Heating device
80 Vibration device

The invention claimed is:

1. A method for manufacturing a cast bar and tube made of a magnesium alloy, said method comprising:

preparing a manufacturing device including, a molten metal furnace holding a casting material as a molten metal therein, the casting material being made of the magnesium alloy, a hollow tube including an opening through which the molten metal enters into the hollow tube from the molten metal furnace, and a cylindrical part in which the molten metal that enters through the opening is received, the hollow tube being freely inserted into and withdrawn from the molten metal furnace at one end portion thereof, a vacuum chamber connected to the hollow tube at another end portion thereof, a depressurization device connected to the vacuum chamber, and generating a negative pressure in the vacuum chamber, a connection member connecting the hollow tube and the vacuum chamber, an open/close valve member installed on the connection member to control a gas flow between the hollow tube and the vacuum chamber, a cooling device connected to the hollow tube and cooling the hollow tube to solidify the molten metal in the hollow tube, a vibrating device installed on the hollow tube and vibrating the hollow tube to uniformly mix the molten metal in the hollow tube, and a heating device arranged outside the hollow tube and heating a vicinity of the opening of the hollow tube, depressurizing the vacuum chamber through the depressurization device while the valve member is closed to generate the negative pressure in the vacuum chamber;

heating the vicinity of the opening of the hollow tube with the heating device before inserting the opening of the hollow tube into the molten metal furnace;

inserting the opening of the hollow tube into the molten metal held in the molten metal furnace;

switching the valve member to be open to introduce the molten metal into the cylindrical part from the molten metal furnace;

introducing the molten metal into the cylindrical part from the molten metal furnace through the opening with a suction force generated by a pressure difference between the hollow tube and the vacuum chamber, and filling the cylindrical part with the molten metal to manufacture the cast bar and tube made of the magnesium alloy;

cooling the hollow tube with the cooling device while introducing the molten metal into the cylindrical part to solidify the molten metal in the cylindrical part; and continuously vibrating the hollow tube after the molten metal is introduced into the cylindrical part until completing solidification of the molten metal in the cylindrical part;

wherein the negative pressure generating the suction force is stably formed in the vacuum chamber, and the negative pressure in the vacuum chamber is varied depending on a size of the hollow tube, the vibrating device includes an enforced vibration device externally applying physical vibration, an ultrasound vibration device applying ultrasound waves or an electromagnetic induction vibration device applying electromagnetic induction, after the vicinity of the opening of the hollow tube is heated with the heating device, the opening of the hollow tube is inserted into the molten metal furnace to prevent breakage of the hollow tube caused by a temperature difference between the hollow tube and the molten metal and to prevent plugging of the hollow tube caused by a rapid solidification of the molten metal, an internal structure of the cast bar and tube made of the magnesium alloy is a spheroidized structure, and cracks or seams are not formed in the cast bar and tube made of the magnesium alloy, and when an upset process is performed on the cast bar and tube made of the magnesium alloy, the cast bar and tube made of the magnesium alloy has deformation ability equal to or more than 70 percent, the deformation ability being evaluated by comparing a height of the cast bar and tube made of the magnesium alloy before the upset process with a height after the upset process, and a value of the deformation ability being calculated as dividing a difference height between the height before the upset process and the height after the upset process by the height before the upset process, and multiplying a hundred for percent indication.

2. The manufacturing method according to claim 1, wherein the cast bar and tube made of the magnesium alloy has the deformation ability equal to or less than 82 percent.

3. The manufacturing method according to claim 1, wherein in the step of preparing the manufacturing device, the hollow tube further includes a cooling layer arranged outside the cylindrical part to form a double tube structure, and the hollow tube has a thickness at the one end portion different from that of the another end portion of the hollow tube to correct an unequal cooling force caused by a temperature difference in a length direction of the hollow tube.

4. The manufacturing method according to claim 3, wherein the step of cooling the hollow tube with the cooling device includes a step of injecting a refrigerant from one end of the cooling layer toward another end thereof, and a step of reinjecting the refrigerant extracted from the another end to the one end to circulate the refrigerant between the one end and the another end.

5. The manufacturing method according to claim 4, wherein the step of cooling the hollow tube with the cooling device further includes a step of correcting the unequal cooling force caused by the temperature difference in the length direction of the hollow tube through difference of the thickness of the hollow tube between the one end portion and the another end portion thereof.

* * * * *